United States Patent [19]

Phillips

[11] Patent Number: 4,683,354

[45] Date of Patent: Jul. 28, 1987

[54] APPARATUS FOR SUPPORTING AND ALIGNING EQUIPMENT

[75] Inventor: Samuel J. Phillips, Canoga Park, Calif.

[73] Assignee: Litton Systems, Inc., Beverly Hills, Calif.

[21] Appl. No.: 750,331

[22] Filed: Jun. 28, 1985

[51] Int. Cl.[4] ..... H01H 3/16

[52] U.S. Cl. ..... 200/61.41; 200/61.42

[58] Field of Search ..... 200/6 A, 17 R, 18, 52 R, 200/61.39, 61.41, 61.42, 61.48, 61.58 R, 61.62

[56] References Cited

U.S. PATENT DOCUMENTS 3,323,386 6/1967 Musick et al. ..... 200/6 A X
3,360,620 12/1967 Ward ..... 200/6 A X
3,679,846 7/1972 Dillon et al. ..... 200/6 A
4,159,429 6/1979 Migliardi et al. ..... 200/61.41
4,301,338 11/1981 McMurtry ..... 200/61.41
4,461,936 7/1984 Kimura et al. ..... 200/61.41

*Primary Examiner*—J. R. Scott
*Attorney, Agent, or Firm*—Roy L. Brown

[57] ABSTRACT

Apparatus for supporting equipment in alignment and for re-aligning it when it is accidentally placed out of alignment, including a stator and rotor. The stator is supported, typically, from an overhead rack, and an item to be aligned is supported from the rotor. Should the item to be aligned accidentally be placed out of alignment, apparatus is provided on the rotor and stator to re-align the rotor—and hence the item that was placed out of alignment.

4 Claims, 6 Drawing Figures

APPARATUS FOR SUPPORTING AND ALIGNING EQUIPMENT

BACKGROUND OF THE INVENTION

When working on or testing aligned equipment in a manufacturing or semi-manufacturing environment, a problem arises of accidentally striking or moving the aligned apparatus. If there is a machining, computer or operator error, the item may be damaged by the error itself, or it may be damaged, for example, by shorted electrical wiring or misplaced machining tools.

In a typical example, a manipulator arm, slide mechanism or other tool or work piece positioning device may carry a crash protection switch so that if positional or travel control is lost, or if there is a computer or operator error and a crash occurs, the machine power is disconnected.

Such apparatus, for example, is used in semi-production and production of optical equipment. The inventor has used it in the production of ring lasers.

Further, a frangible link may be inserted between tool holders and manipulator arms, for accidental separation of the tool and arm may damage a work piece.

Any of the above arrangements require replacement of parts, such as broken links, and appreciable readjustment, realignment and set up before the manufacturing may continue.

SUMMARY OF THE INVENTION

The apparatus of this invention comprises a stator member which is supported upon one end, typically from the top. A rotor member is connected, for example as by hanging therefrom, to the stator. The work piece is attached to the rotor.

The rotor of the invention is easily angularly displaced so that should the work piece be accidentally struck or pushed by a manipulator arm or otherwise, the rotor turns. Turning of the arm actuates switches, typically electrical microswitches, to stop all power driven manufacturing processes, thereby obviating further damage to the work piece.

The rotor is adapted, according to the invention to rapid realignment.

It is therefore an object of this invention to provide a stator and rotor which are adapted to support and protect a work piece.

It is another object of the invention to provide a stator and rotor which are rapidly re-aligned after misalignment.

It is still another object of the invention to provide a rotor for carrying a work piece, such rotor being suspended from a stator and aligned therewith, including switching means for removing power from manufacturing machines and processes whenever such rotor and work piece are out of alignment; and means for rapidly re-aligning the rotor and work piece with the stator.

Other objects will become apparent from the following description, taken together with the accompanying drawings.

DESCRIPTION OF THE PREFERRED EMBODIMENT

Figure 1:
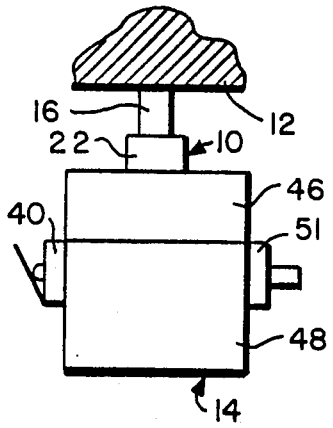
FIG. 1 is a profile view of the apparatus of the invention.
Figure 2:
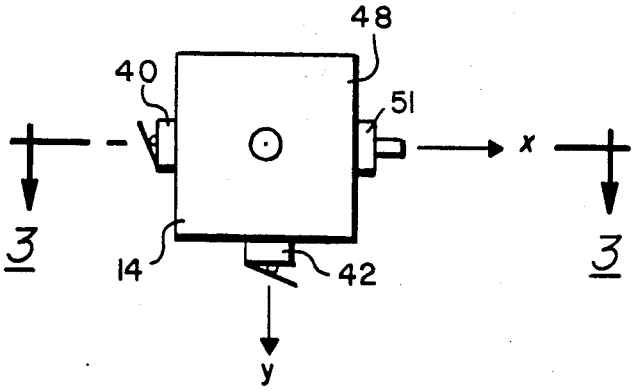
FIG. 2 is a view taken from the bottom of FIG. 1.

In the preferred embodiment, the stator 10 is suspended from, typically, a stationary member 12. A rotor 14 is supported by the stator 10 with three degrees of angular freedom. The rotor 14 is attached to a work piece (not shown) which it is designed to protect. There is a preferred alignment of the rotor and, therefore, the work piece. Details of the stator 10 and rotor 14 may be observed from FIG. 3.

A downwardly extending support member or strut 16 is attached to a supporting frame or the building 12, and it acts as a housing for an actuator 18. The actuator 18 may be electrical, but it could also be pneumatic, vacuum, or hydraulic. Other types of actuators for the centering pintle 20 are not to be excluded. The pintle 20 extends downward in a sliding fit through the stator and extends out of the bottom to engage the guiding or camming surface 32 of the rotor 14 as described hereinafter. The shank 22 is shown circularly cylindrical about the z axis, and the z axis is shown vertical along the axis of the pintle 20. At the base of the shank 22 is shown a spherical zonal surface 24. The zone 20 extends completely around the z axis and through, typically, about ten to twenty degrees about the x and y axes.

Figure 3:
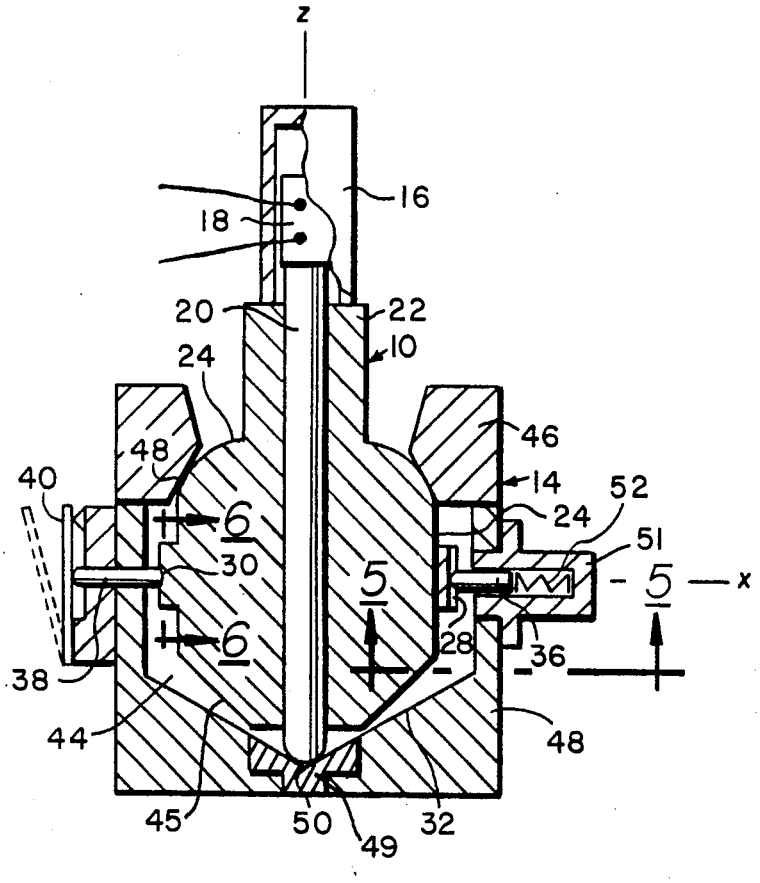
FIG. 3 is a sectional view taken at 3—3 in FIG. 2.
Figure 4:
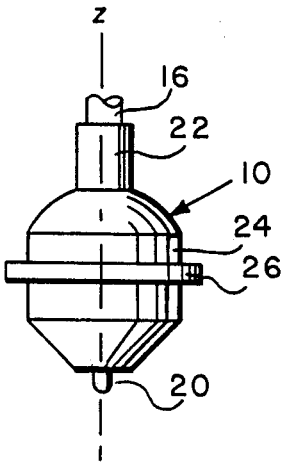
FIG. 4 is a profile view of the stator of the invention.
Figure 6:
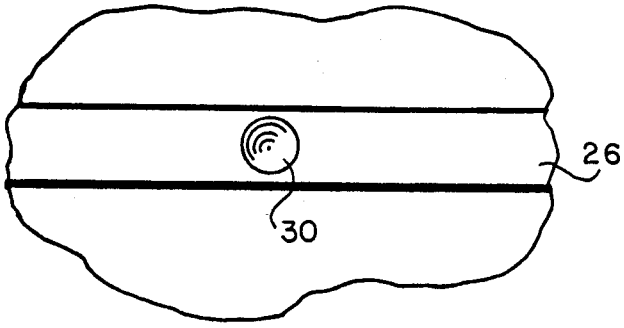
FIG. 6 is a view of the stator taken at 6—6 in FIG. 3.

The central portion of the stator 10 has a cylindrical surface 24 with a flange 26 in the x-y plane. An indexing pintle housing 51 is positioned on the rotor 14. It encloses an indexing pintle 36 and an inwardly biasing spring 52 as shown in FIG. 3. The housing 51, pintle 38 and spring 52 are positioned so that when the rotor is properly aligned, the axis of the indexing pintle 38 is along the x axis. For receiving the indexing pintle 36, the flange 26 has an extended indexing-pintle-receiving groove or detent 28 therein centered on the x axis, such detent being substantially parallel to the z axis. It also has a pair of small detents 30 therein, such as the detent shown on the x axis in FIG. 6, for receiving the actuating pins 38 of the switches 40 and 42. The bottom outer surface 45 of the stator 10 is shown conical, but its shape is not critical, for it merely must clear the rotor 14.

The rotor 14 surrounds the stator 10, and it forms a cavity 44 to allow it to do so. The rotor 14 is shown formed of two portions 46 and 48 to allow it to be assembled around the stator 10. The upper portion 46 has an inner surface 48 which is shown conical, but it may be spherical, to slide on the surface 24 to support the rotor 14 and to allow three degrees of rotation of the rotor 14 relative to the stator 10. The bottom of the cavity 44 is guided or cammed by the conical camming surface 32, which may be curved, to a low point 50. The point 50 is on the z axis when the rotor 14 is aligned in its preferred alignment.

Figure 5:
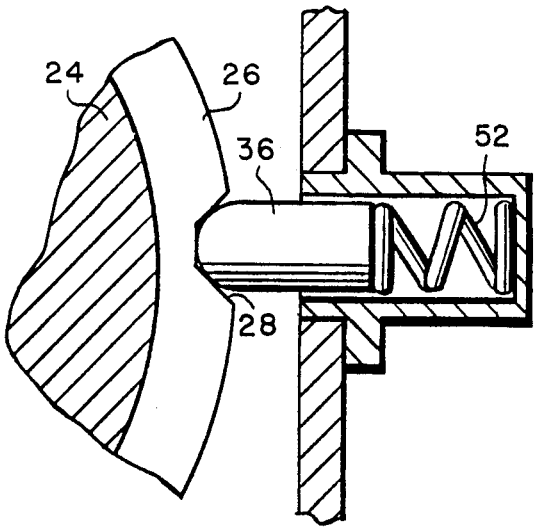
FIG. 5 is a view, partly in section, taken at 5—5 in FIG. 3.

To keep the rotor 17 light, it may be made of light-weight metal, but the light-weight metal might be too soft to hold the alignment. A portion of the light weight softened metal, at and adjacent the z axis, may be removed, and a hardened plug 49 inserted in its place. The centering pintle 36 engages the groove 28, shown in FIG. 5, and the axis of the pintle 36 is aligned with the x axis when the rotor 14 is aligned in its preferred alignment. The pintle 36 is biased inwardly into groove 28 by the bias of spring 52. Switches 40 and 42, shown here as electrical microswitches, are positioned to open when the rotor is misaligned from the x and y axes. Only one pintle 38 is shown in FIG. 3 for a typical microswitch.

In operation, a work piece (not shown) is attached to the rotor, and the actuator 18 is actuated to force the centering pintle 20 against the guiding or camming surface 32 which drives the pintle to the low point 50. When the apparatus is assembled, the pintle 36 is assembled into the groove 28 to constrain the rotor from turning around the z axis. With the rotor 14 and stator 10 aligned, the pintles 38 fit into their respective detents 30, and the switches 40 and 42 are closed.

Should the work piece (not shown), and hence the rotor 14, be knocked or otherwise thrown out of alignment, pintles 38 are displaced out of their detents 30, and the electrical system to which they are attached is de-energized. To re-align the rotor about the x and y axes, the actuator 18 is energized, and the pintle 20 is driven against the guiding or camming surface 32, forcing the pintle toward the lowest point 50. When it reaches the lowest point 50, the rotor is re-aligned about the x and y axes. If, however, the rotor is placed out of alignment about the z axis, it would need to be turned by hand until the pintle 36 again engages the groove 28. When all is again in alignment, the pintles 38 engage the detents 30, closing the microswitches 40 and 42.

I claim:

1. Means for supporting and aligning equipment in a three axes cartesian coordinate system comprising:

a stator, supported upon its top end and having a downwardly biased extendible centering pintle positioned for axial movement along a substantially vertical z axis, an indexing-pintle-receiving detent groove on the outer side surface thereof and substantially parallel to but offset from said z axis, and a spherically-zonal-shaped supporting-surface symmetrical about said first axis proximal to said supported top end;

said stator having a pair of substantially horizontal perpendicular axes, x and y, defining an orthogonal set of axes with said z axis, said x axis intersecting substantially the center of said indexing-pintle-receiving detent groove;

a rotor, forming a cavity surrounding said stator, said cavity having an inner surface supported by but free to slide on said spherically-zonal-shaped supporting-surface to support said rotor, a centering-pintle-receiving detent in the bottom surface of said cavity for engaging said centering pintle to align said rotor with said z axis, a cammed guiding surface on the bottom surface of said cavity adjacent said centering-pintle-receiving detent for guiding said centering pintle into said centering-pintle-receiving detent, and an inwardly-biased indexing pintle positioned for sliding movement relative to said rotor, on an axis perpendicular to the axis defined by said centering-pintle-receiving detent, to engage said indexing-pintle-receiving detent groove on said stator to hold the alignment of said indexing pintle with said x axis and said rotor about said z axis.

2. Apparatus as recited in claim 1 and further comprising a pair of equipment connecting and disconnecting switches on said rotor, biased toward their closed positions, and switch pintles for opening said switches, respectively, positioned to move inward and outward along a pair of axes perpendicular and parallel to the axis of said indexing pintle and perpendicular to the axis defined by said centering-pintle-receiving detent for alignment with said x and y axes; and third and fourth detents upon the x and y axes of said stator for engaging said switch pintles only when said last-named pair of axes are aligned with said x and y axes and perpendicular to said z axis.

3. Apparatus as recited in claim 2 and further comprising actuator means for forcing said extendible centering pintle toward and against said cammed guiding surface and said centering-pintle-receiving detent to realign said rotor with said z axis.

4. Apparatus as recited in claim 3 in which said switches are electrical switches which are closed when said indexing pintle is aligned with said indexing-pintle-receiving detent and said centering pintle is aligned with said centering-pintle-receiving detent.

* * * * *